US005189242A

United States Patent [19]

Usa

[11] Patent Number: 5,189,242

[45] Date of Patent: Feb. 23, 1993

[54] ELECTRONIC MUSICAL INSTRUMENT

[75] Inventor: Satoshi Usa, Hamamatsu, Japan

[73] Assignee: Yamaha Corporation, Hamamatsu, Japan

[21] Appl. No.: 703,370

[22] Filed: May 21, 1991

Related U.S. Application Data

[62] Division of Ser. No. 423,971, Oct. 19, 1989, Pat. No. 5,054,361.

[30] Foreign Application Priority Data

Oct. 27, 1988 [JP] Japan ..... 63-271834

[51] Int. Cl.[5] ..... G10H 11/00; G10H 1/34

[52] U.S. Cl. ..... 84/743; 84/DIG. 10; 84/DIG. 21; 84/DIG. 26

[58] Field of Search ..... 84/662, 670, 701, 718, 84/737, 743, DIG. 10, DIG. 26, DIG. 21

[56] References Cited

U.S. PATENT DOCUMENTS 3,064,515 11/1962 Markowitz ..... 84/718
3,696,700 10/1972 Berardi ..... 84/743 X
3,813,473 5/1974 Terymenko .
4,245,540 1/1981 Groupp ..... 84/726
4,907,483 3/1990 Rose et al. ..... 84/726
4,998,960 3/1990 Rose et al. ..... 84/726
5,054,361 10/1991 Usa ..... 84/737
5,062,342 11/1991 Nagatsuma ..... 84/744

FOREIGN PATENT DOCUMENTS 1600284 10/1981 United Kingdom .

*Primary Examiner*—William M. Shoop, Jr.
*Assistant Examiner*—Brian Sircus
*Attorney, Agent, or Firm*—Spensley Horn Jubas & Lubitz

[57] ABSTRACT

A vibrator for vibrating an electronic musical instrument in accordance to the generated tone being produced. In this manner, a player of the electrical musical instrument will have the sensation of playing a conventional musical instrument due to the feedback of vibrational energy into the input device of the electronic musical instrument.

10 Claims, 10 Drawing Sheets

8:Vibrating frame

ELECTRONIC MUSICAL INSTRUMENT

This is a division of application Ser. No. 07/423,971, filed on Oct. 19, 1989, now U.S. Pat. No. 5,054,361.

Background of the invention 1. (Field of the invention)

This invention relates to an electronic musical instrument which features a simulated vibration of a conventional musical instrument during playing.

2. (Description of the prior art)

The available musical instruments are roughly grouped into electronic musical instruments and natural musical instruments. The most remarkable difference between them is the applied sound sources. Namely, the sound source of the electronic musical instrument is composed of electronic circuits whereas the sound source of the natural musical instrument is a vibrator such as strings and reeds. For example, the sound source of a piano and a guitar is the vibration of the strings, the sound source of wood-wind instruments, such as a clarinet and the vibration of the reed, and the sound source of brass such as a trumpet is the vibration of the lips.

Thus, there is a significant difference in the sound source between the electronic musical instruments and the natural musical instruments. Owing to this difference the electronic musical instrument cannot give such vibration feeling during playing as that given by the natural musical instruments, so that the player of the electronic musical instrument cannot feel the actual playing. It is desirable for sounds the player to sense the sound vibration through his fingers and lip in addition to listening sounds from the speaker. The natural musical instrument allows the player to sense such a sound dynamics but the electronic musical instrument cannot give such a sound dynamics. This is due to that the sound source of the electronic musical instrument is composed of the electronic circuit which does not generate mechanical vibration. The electronic musical instrument comprising the play information input device not provided with the sound source and the speaker features that the signals flow in one direction, namely from player→ input device→ (external memory) (or other electronic musical instrument) unless a sound system is provided as an external device, and therefore the feedback of playing sound to player's ears is not provided, as a result of which the player cannot get the vivid playing feeling.

Thus, the well known electronic musical instrument is inferior in possibility of giving the playing feeling to the player, thereby lacking in playing response to the player.

SUMMARY OF THE INVENTION

In brief, my invention contemplates a means for vibrating the vibrators located in proper positions of a body of an electronic musical instrument according to the playing signals generated by the operation of a keyboard.

It is an object of the invention to provide an electronic musical instrument which can give the vibration feeling to the player during playing by providing the vibrators in proper places of the body of the electronic musical instrument.

The electronic musical instrument of this invention is designed so that when the playing signals are generated by operation of the keyboard the vibrator provided in a proper place of the body of the electronic musical instrument is driven by the playing signals, and as a result the electronic musical instrument itself is finely vibrated by the vibrator and the vibration can be sensed by the player through his fingers. This makes it possible to compose a vibration feedback system for the player through the electronic musical instrument which is not provided with a speaker or to compose both sound feedback system and vibration feedback system for the player through the electronic musical instrument provided with a speaker. This feedback system allows the player to sense his own playing.

BRIEF DESCRIPTION OF THE DRAWINGS

The invention will now be described with reference to the accompanying drawings wherein.

FIG. 1 shows the concept of this invention, whereas

DESCRIPTION OF THE PREFERRED EMBODIMENT

Figure 1:
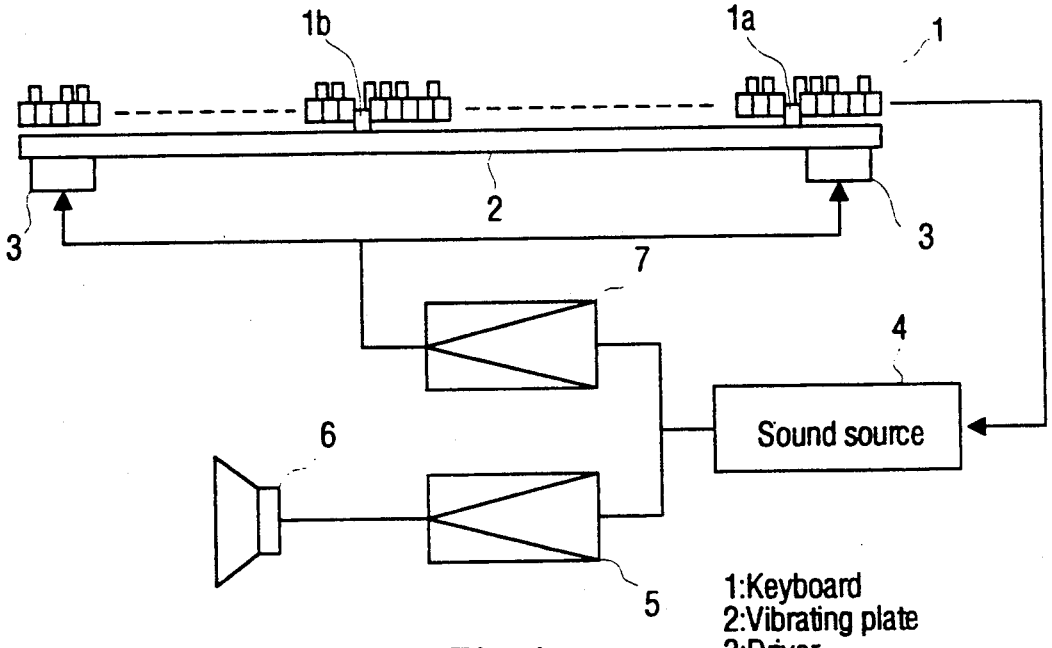
Figure 2:
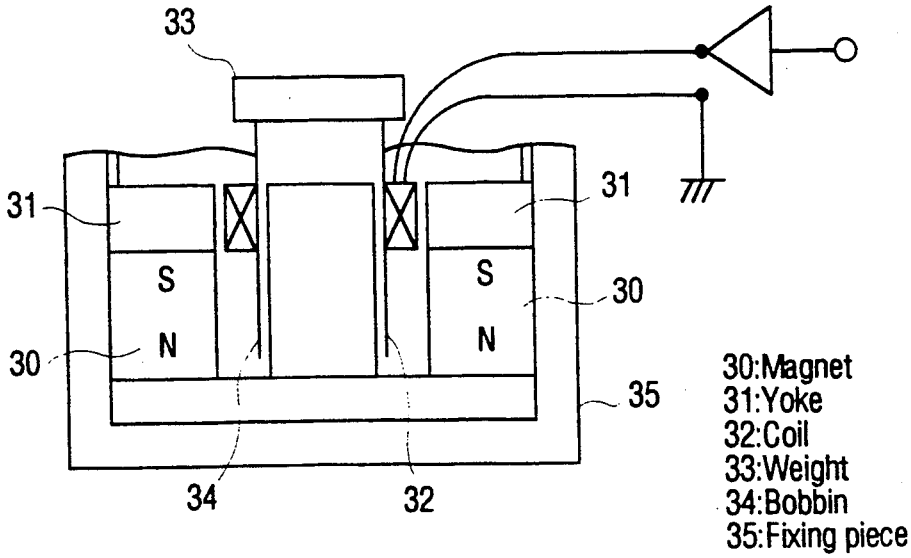
FIG. 2 shows the structure of a driver.

FIG. 1 shows the concept of the electronic piano which is an example of application of this invention. Under a keyboard 1 a vibrating plate 2 is located. The vibrating plate 2 comprises one thin metallic plate covering the whole lower part of the keyboard 1. In the proper position at its left and right sides a driver 3 having a sufficient driving power to vibrate the vibrating plate 2 is provided. This driver 3 has the configuration similar to that of the voice coil which is provided in the speaker as shown, for example, in FIG. 2. Namely, a coil 32 is wound around a bobbin 34 which is supported at the center so that it can be moved freely up and down. Beside the bobbin a magnet 30 and an yoke 31 are arranged. A weight 33 is fitted to the upper part of the bobbin 34 instead of cone paper of speaker. When AC drive signal is supplied to the driver 3 having such a structure, the weight 33 and a fixing piece 35 vibrate relatively. Accordingly, if the weight 33 or the fixing piece 35 is fitted to the vibrating plate 2 and the driver 3 is driven with the playing signals, the vibrating plate 2 vibrates according to the playing signals. On the other hand, when a key is pressed, its lower surface contacts the vibrating plate 2. Therefore, if the vibrating plate 3 is vibrating when the key is pressed, vibration is transmitted from the pressed key to the player's finger.

When any key of the keyboard is pressed, the keyboard 1 outputs the key code allocated to the pressed key to a sound source circuit 4. This sound source circuit 4 creates the musical tone signal corresponding to the above-mentioned key code. When the keyboard 1 is continuously operated, the above-mentioned musical tone signals are outputted as continued play signals from the sound source 4. The playing signals are outputted from a speaker 6 through an amplifier 5. The playing signals are imparted to the above-mentioned driver 3 through an amplifier 7. Accordingly, the driver 3 is driven by the playing signals.

Such a configuration features that when the player plays a musical instrument, using the keyboard 1, the playing sound is heard from the speaker 6, and at the same time the vibrating plate 2 vibrates according to the playing signals generated by playing operation, thereby allowing the player to sense vibration through his finger.

Figure 3A:
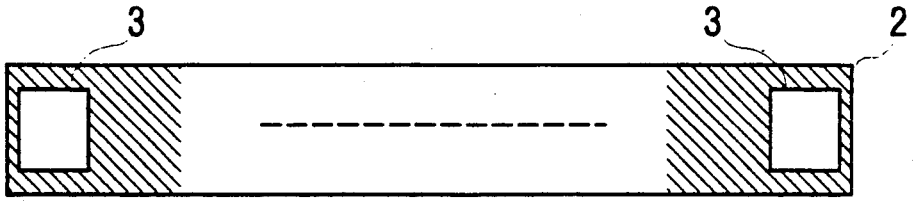
FIG. 3 (A) and (B) show the examples of the arrangement of a vibrating plate.
Figure 3B:
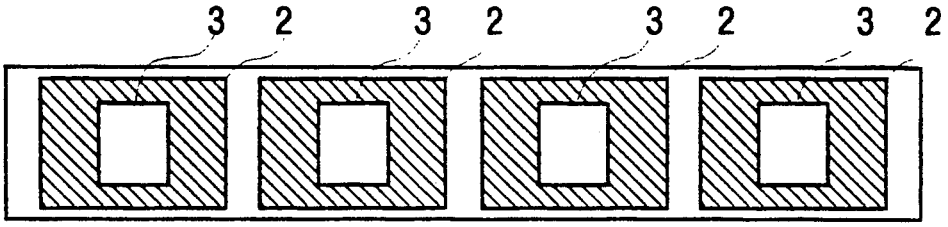

FIG. 3 (A) and FIG. 3 (B) show an example of above-mentioned vibrating plate 2. FIG. 3 (A) shows the vibrating plate which is arranged opposing to the whole lower part of keyboard 1 as shown in FIG. 1 whereas FIG. 3 (B) shows an example where the whole keyboard 1 is divided into 4 zones by compass, the vibrating plate 2 is provided for each zone, and the vibrating plates are fitted to a vibrating frame which is arranged opposing to the whole lower part of keyboard 1. When the vibrating plate 2 is arranged as shown in FIG. 3 (B), these four vibrating plates are provided with the driver 3. In this configuration the vibrating plate located below the pressed key is driven.

Figure 5:
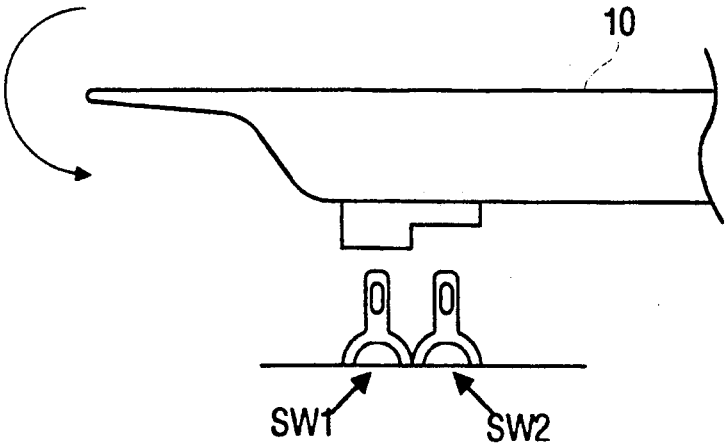
FIG. 5 shows the configuration of a keyboard.
Figure 4:
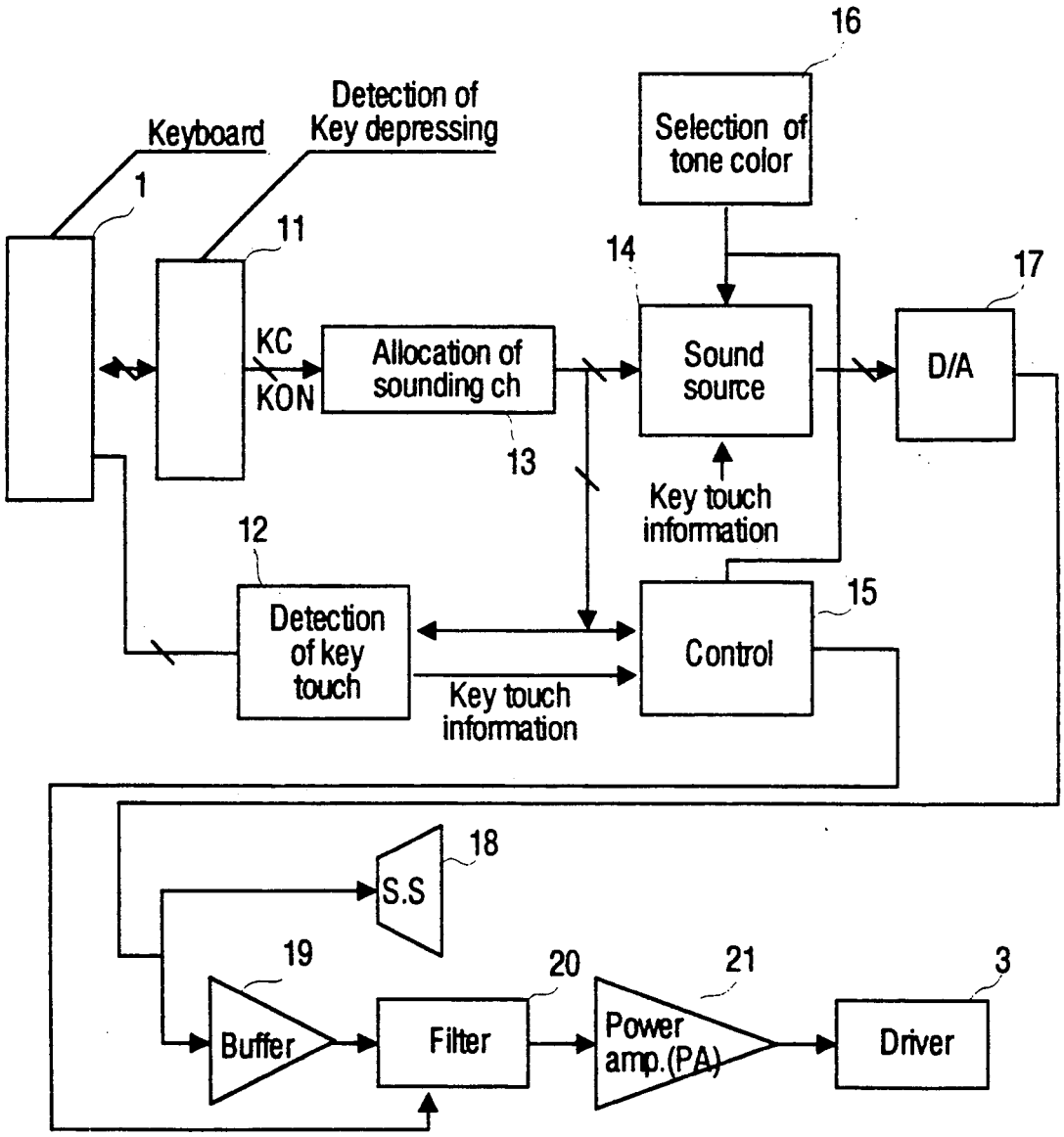
FIG. 4 is a block diagram of a control unit of the above-mentioned electronic piano.

FIG. 4 is a block diagram of a control unit of the above-mentioned electronic piano. Each key of keyboard 1 has the configuration shown in FIG. 5. Under the key 10, two switches SW1 and SW2 are located. When a key is depressed, a switch SW1 is turned on first, then a switch SW 2 is turned on. Output of each switch SW1 and SW2 is led to a key depressing detecting circuit 11 and a key touch detecting circuit 12. The key depressing detecting circuit 11 recognizes the depressed key according to the given switch output, and outputs the key code KC corresponding to the depressed key and the key-on signal KON indicating the key depressing status. The key touch detecting circuit 12 counts the time from turning-on of the switch SW1 to turning-on of the switch SW2. Based on the count data the key depressing speed, namely the intensity of key pressing, is detected and outputted as key touch information.

The key code KC and key-on signal KON outputted from the key depressing detecting circuit 11 are inputted to a sounding channel allocation circuit 13 where the sounding channels are allocated. As a matter of course, a well-known truncate processing circuit can be incorporated in the sounding channel allocation circuit 13.

From the above-mentioned sounding channel allocation circuit 13 the key code KC and key-on signal KON are sent to a sound source circuit 14, a key touch detecting circuit 12, and a control circuit 15 as time-shared signals for each allocated sound channel. The sound source circuit 14 incorporates a musical tone waveform generating circuit including a waveform memory and a phase data generating circuit which generates the phase data determining the frequency of musical tone waveform generated by this musical tone waveform generating circuit. The phase data generating circuit generates the phase data corresponding to the key code KC included in the information outputted from the sound channel allocation circuit 13. The key touch information detected by the key touch detecting circuit 12 is inputted to the musical tone waveform generating circuit included in the sound source circuit 14, and the sound tone information is inputted from a tone color selecting circuit 16 thereto. In the musical tone waveform generating circuit, the musical tone data is read from the waveform memory according to the phase data generated in the phase data generating circuit, and for the musical tone data the amplitude modulation is performed based on the key touch information and sound tone information, and the obtained information is outputted to a D/A converter 17 provided in the latter stage.

The D/A converted signal is sent to a sound system 18 as playing signal. Here, the signal is acoustically outputted as musical sound. Since the key depressing information (key code KC and key-on signal KOH) is outputted as time-shared signal from the sound channel allocation circuit 13 for each allocated sound channel, the above-mentioned processing is performed as time-shared processing also in the sound source circuit 14.

The key touch information is inputted from the key touch detecting circuit 12 to the control circuit 15. The key depressing information is inputted from the sound channel allocation circuit 13 to the control circuit 15, and moreover the sound tone information is inputted from the sound tone selecting circuit 16 thereto. Based on these informations the control circuit 15 creates the control signal for the filter mentioned later.

The playing signal outputted from the D/A converter 17 is sent to a sounding system 18 and at the same time to a filter 20 comprising, for example, a low pass filter LPF, through a buffer 19 thereby to modify the playing signal. In the filter 20 the high range component of the playing signal is removed, and thus obtained signal is outputted to a power amplifying circuit 21 provided at the latter stage where it is converted to a vibrating plate drive signal of a proper level. And then, it is sent to the driver 3 designated to drive the vibrator 2. The filtration rate of the filter 20 is controlled by the output signal from the control circuit 15. Its control method is such that the cut-off frequency of the filter is changed so that the vibration transmitted to the player's finger changes depending on the key pressing position, the key touch state or the sound tone. For example, if the key pressing position is in the high range, the cut-off frequency of the filter is shifted to the high range so that the pass frequency band is widened. The signal which passed the filter 20 is converted in a power amplifying circuit 21 to a signal capable of sufficiently driving the driver 3. Then, it vibrates the vibrating plate 2 through the driver 3.

Figure 6:
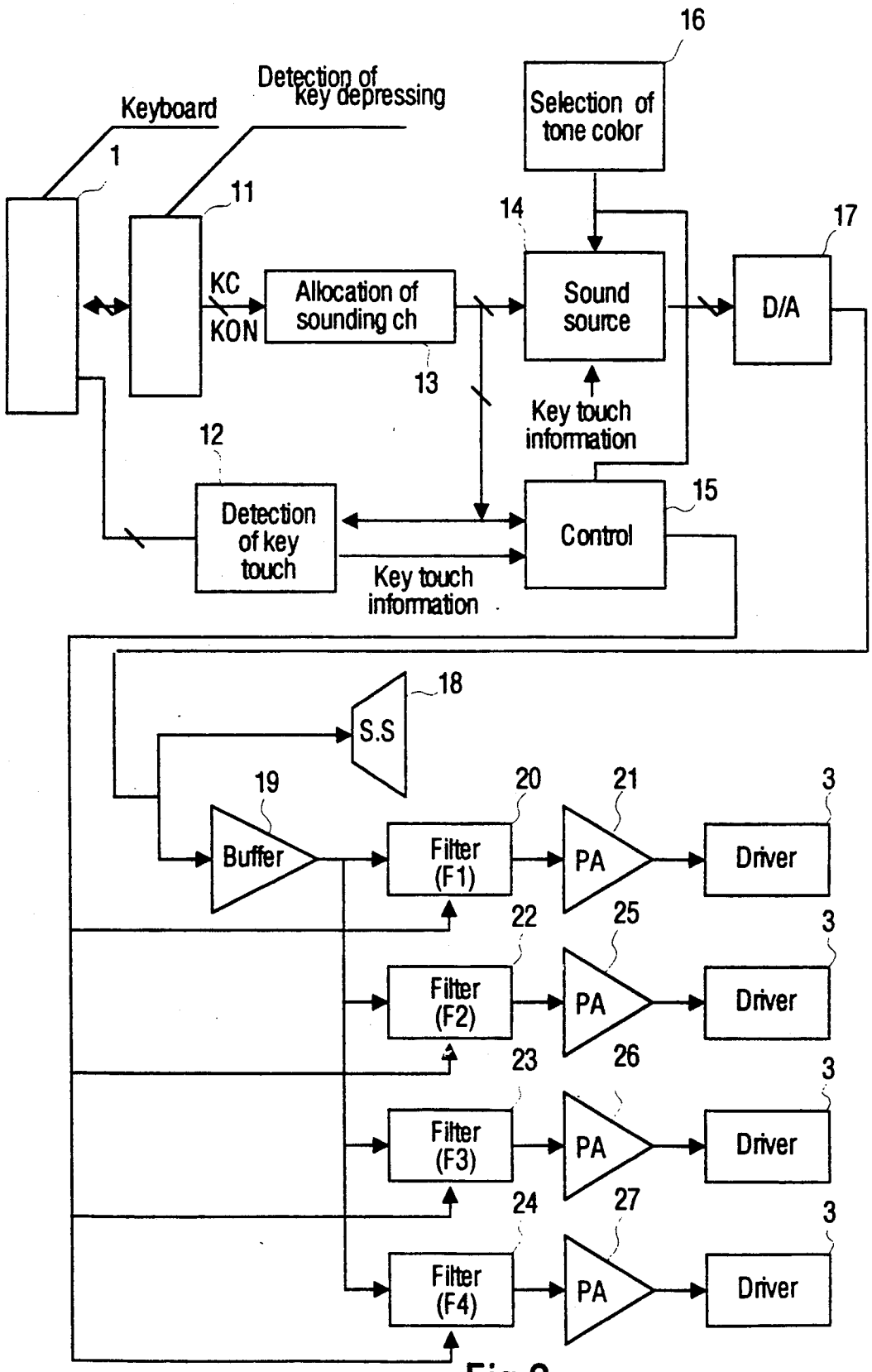
FIG. 6 shows an example of other configurations of the control unit.
Figure 7A:
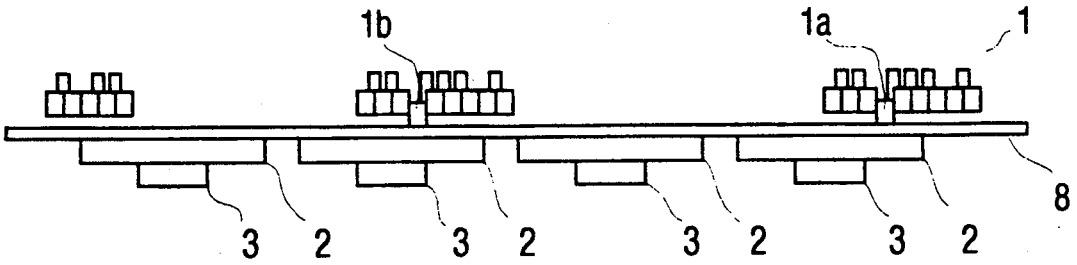
FIG. 7 (A) to (C) show the characteristics of a filter and the arrangement of the keyboard and vibrating plate.
Figure 7B:
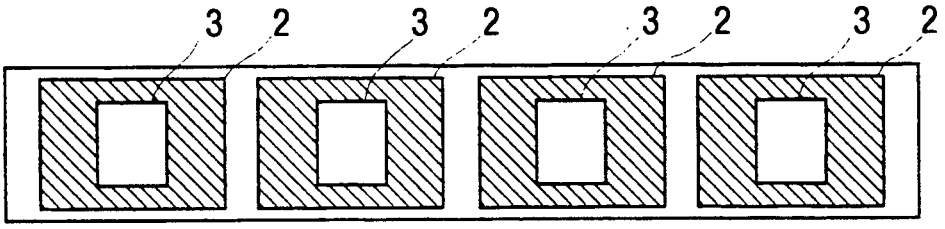
Figure 7C:
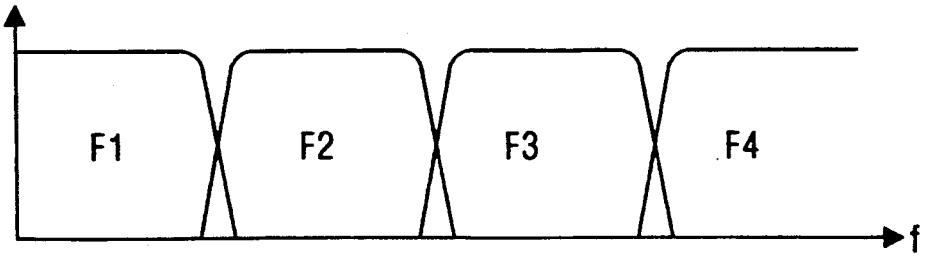

FIG. 6 is a block diagram of the control unit which is used when the vibrating plate 2 is divided into 4 divisions as shown in FIG. 3 (B) and each of them is driven individually by the specific driver. In configuration it differs from the control unit shown in FIG. 4. Namely, the filter, the power amplifying circuit and the driver are provided independently for the four vibrating plates 2. FIG. 7 (A) to FIG. 7 (C) show the location of the keyboard and the vibrating plates relating to the filter characteristics. In FIG. 7 (C), the filter 20 (F1) passes the low frequency band sound whereas the filter 22 (F2) passes the low to medium frequency band sound. The filter 23 (F3) passes the medium to high frequency band sound, whereas the filter F4 passes the high frequency band sound. Accordingly, when the low frequency band key of the keyboard in FIG. 7 (A) is depressed, the vibrating plate 2 (leftmost vibrating plate in FIG. 7 (B)) located just under the key is vibrated. When the high frequency band key in FIG. 7 (A) is depressed, the vibrating plate 2 (rightmost vibrating plate in FIG. 7 (B)) located just under the key is vibrated. When the low to medium frequency band key is depressed, the vibrating plate 2 (second vibrating plate from the leftmost side in the figure) located just under the key is vibrated. When the medium to high frequency band key is depressed, the vibrating plate (second vibrating plate from the right side in the figure) located just under the key is vibrated. Accordingly, when the leftmost vibrating plate 2 is vibrated, the end part of left side of the vibrating frame 8 is most strongly vibrated. Therefore strong vibration is sensed from the key depressed in close proximity to it. The control unit 15 delicately controls the cut-off frequency of these filters according to the key code of the pressed key, selected sound tone and key touch state of the pressed key. This delicate filter control ensures natural vibration sensing more resembling the real piano effects than that obtained from the equipment shown in FIG. 4.

Figure 8:
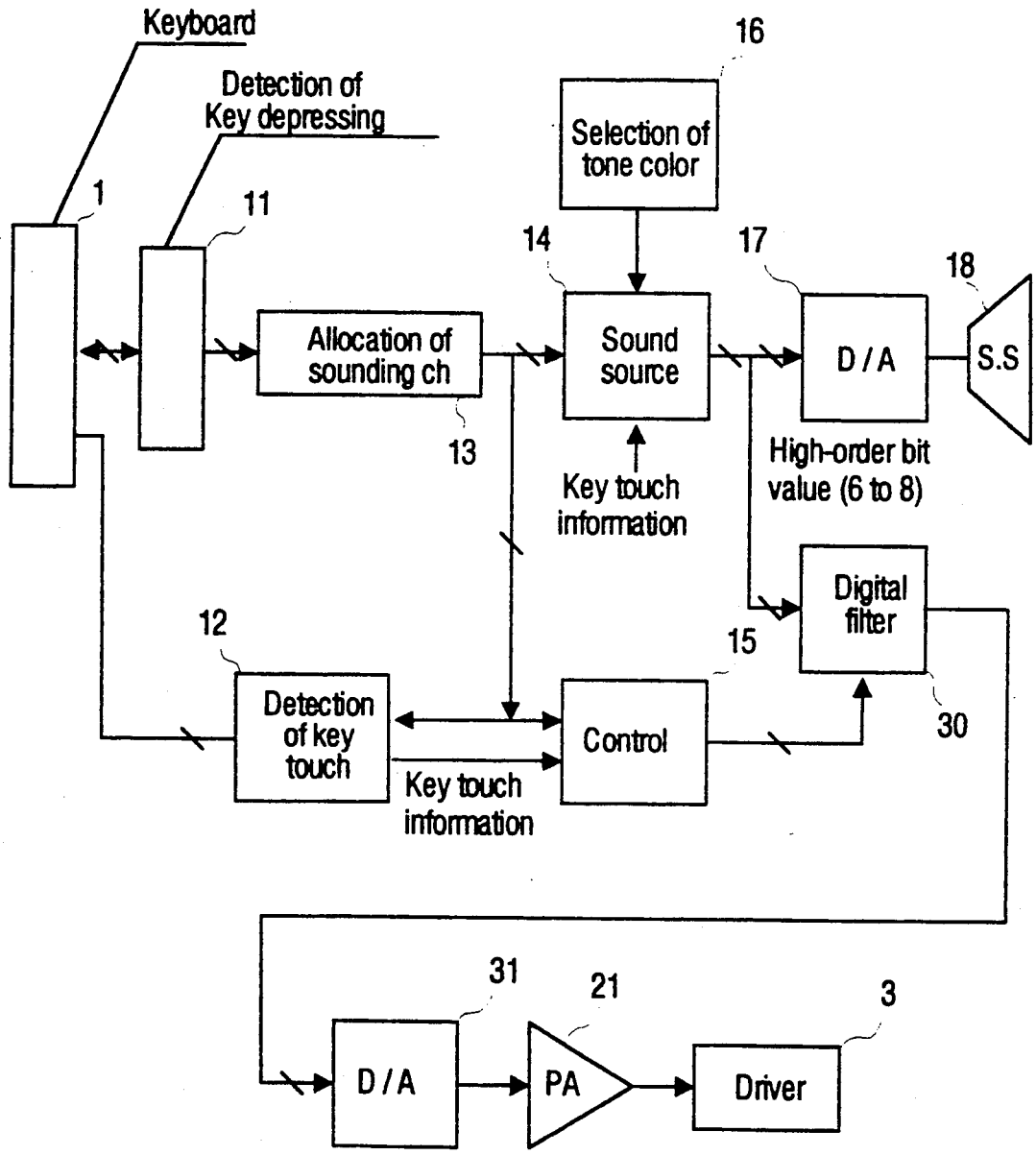
FIG. 8 and FIG. 9 show the example of other configurations of the control unit.

FIG. 8 shows other an example of an embodiment of the present invention. In configuration it differs from the equipment shown in FIG. 4. The difference is that a digital filter 30 is provided instead of analog filter 20. Namely, in this example of embodiment the filtration is performed before D/A conversion. In this example of an embodiment the data outputted from the sound source circuit 14 has 8-bit length, whereas the data to be sent to the digital filter 30 is allocated to 3 bits (high-order 6 to 8 bit). It is allowed that the signal component to be sent to the driver 3 is to be major component of amplitude information. Therefore such information is sufficient as information to be given to the digital filter 30. As the digital filter is used for filtration as with a preferred embodiment, the filter control in the control section 15 can be executed more finely.

Figure 9:
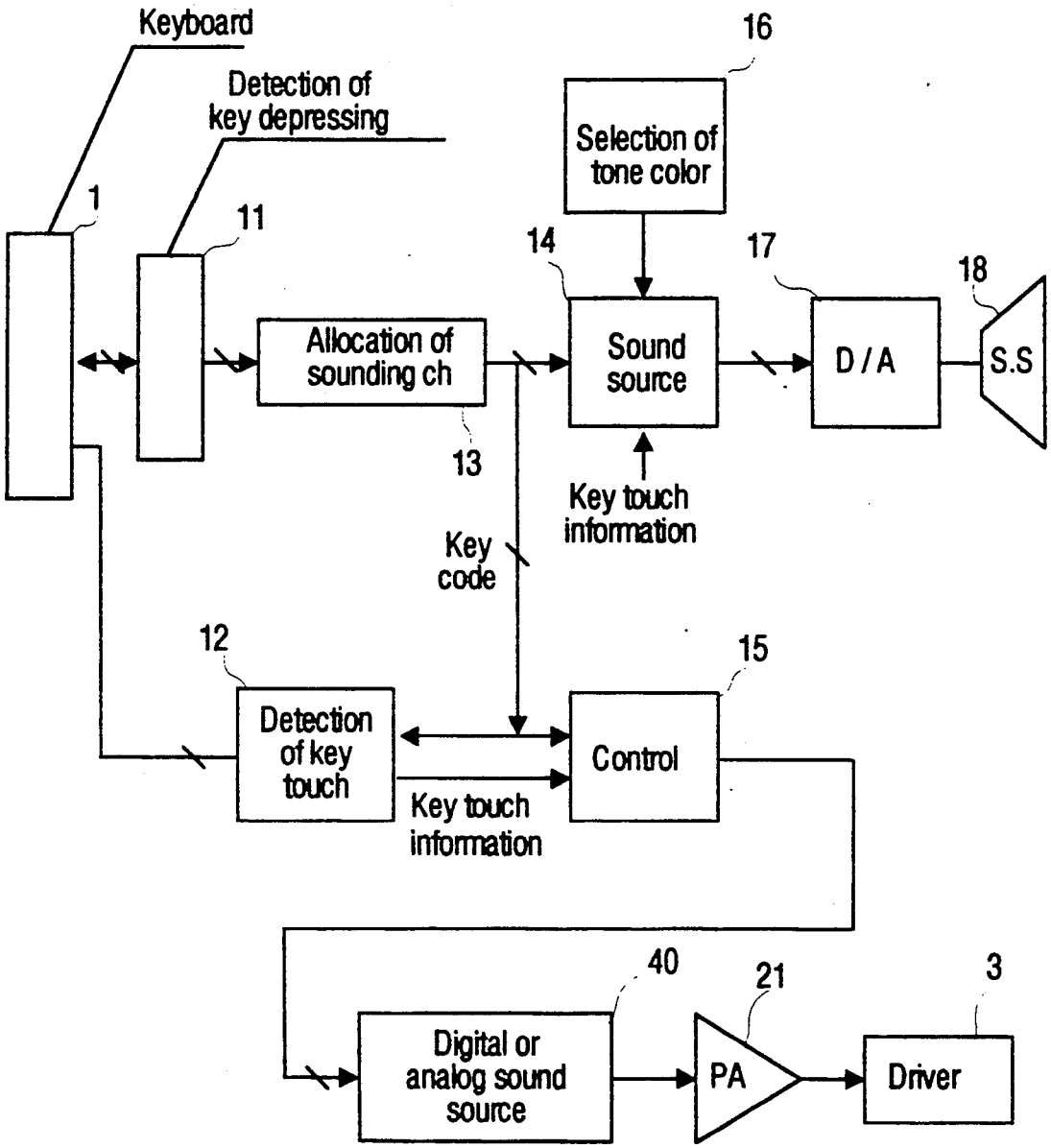

FIG. 9 shows another example of an embodiment of the present invention. In a preferred embodiment a digital sound source or an analog sound source 40 is provided, and the sound source is used to drive the driver 3. The equipment shown in FIG. 4 and FIG. 8 is designed so that the driver 3 is driven directly by the playing signals. In this example of an embodiment the digital sound source or analog sound source 40 is driven according to the playing signals, and the driver 3 is driven by using this sound source. In the case where the digital sound source is used, a memory for storing the waveform of vibration which occurs on a real keyboard of a piano is used. Accordingly, vibration of the keyboard which occurs due to depressing of a key of real piano is detected by the sensor, and the sensed vibration information is stored in the memory. If in this case two or more vibrating plates are used as shown in FIG. 3 (B), vibration information of several places is stored in the memory. This memory is used as a sound source. The vibration information corresponding to the pressed key is read from the memory, and the driver 3 is driven. If the analog sound source is used, the type of waveform of oscillator and waveform combination are previously selected so as to ensure the same vibration as that of real piano. Applicable waveforms are sine wave, triangular wave and square wave as well as pulses.

Thus, if the driver 3 is driven with the signals from the digital sound source or analog sound source, it is possible to get the vibration feeling more resembling the vibration feeling of real piano than that of the equipment shown in FIG. 4 and FIG. 8 by applying a proper sound source.

Figure 10:
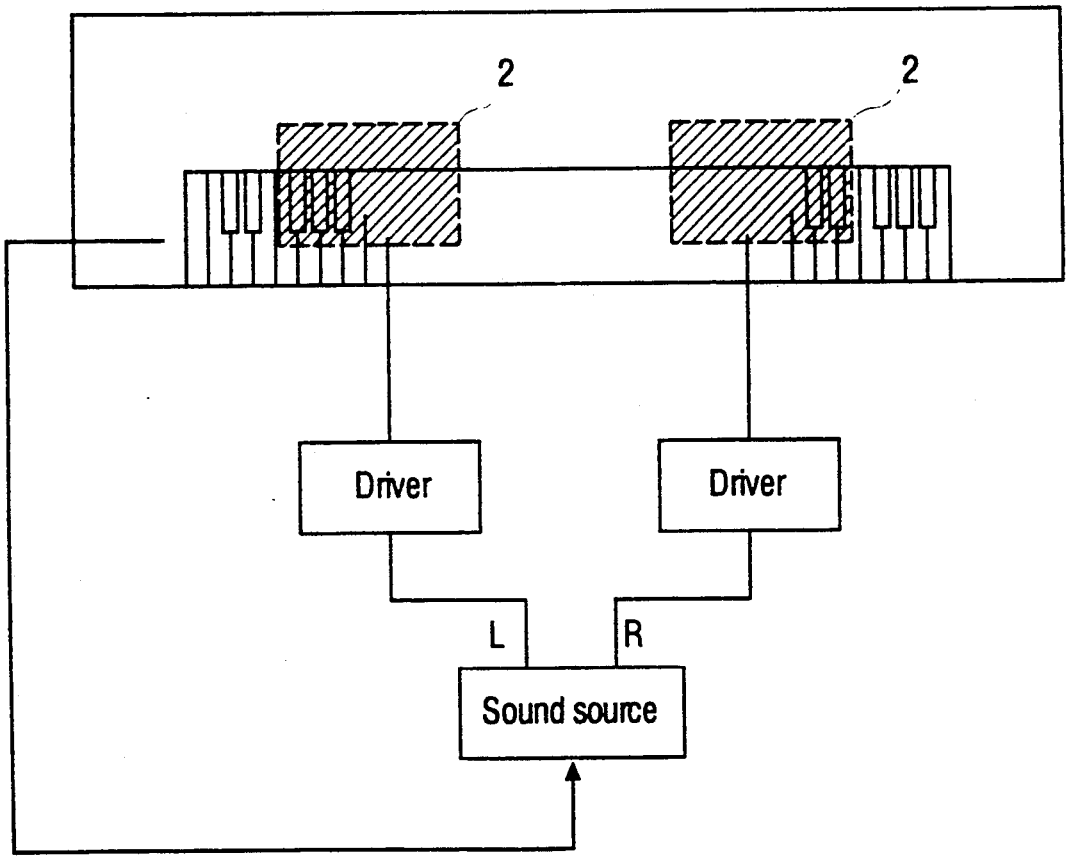
FIG. 10 shows the example of other arrangements of the vibrating plate and its driving method.

For the vibrating plate location and driving method other variations are possible. For example, the vibrating plate 2 is located at the left and right sides of the keyboard 1 as shown in FIG. 10, so that these two vibrating plates 2 are driven with stereo signals. This invention is applicable also to another electronic musical instruments in addition to the above-mentioned electronic piano.

Figure 11:
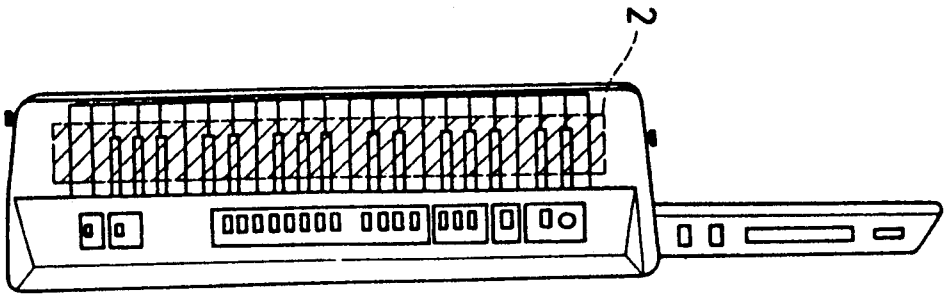
FIG. 11 (A) to (D) show the examples of the application of this invention for various electronic musical instruments.
Figure 11:
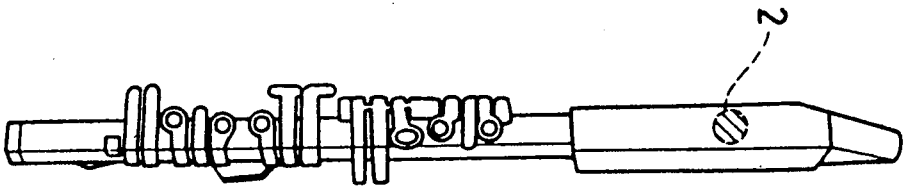
Figure 11:
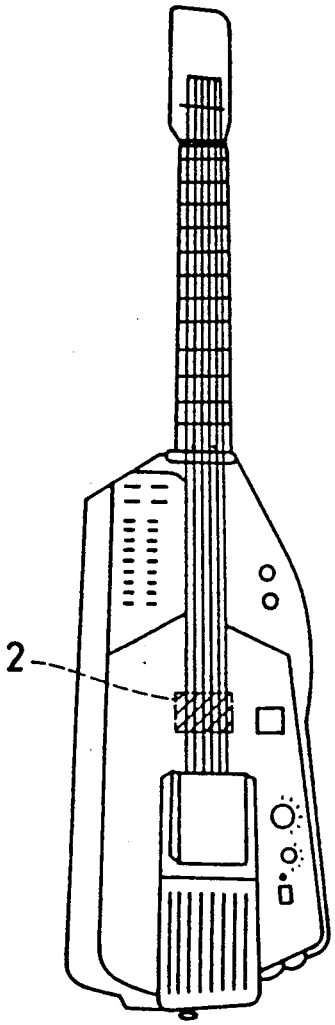
Figure 11:
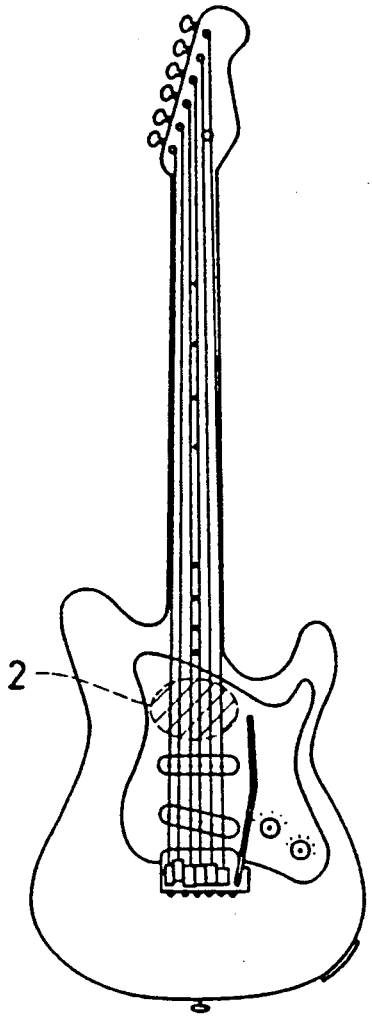

FIG. 11 (A) to FIG. 11 (D) show the examples of application of this invention to the shoulder type MIDI controller, MIDI wind controller, electric guitar, guitar type MIDI controller.

The piezoelectric element is a small vibrator suited to the electronic musical instrument as shown in FIG. 11 (B).

What is claimed is:

1. An electronic musical instrument, comprising:

input means, adapted for contact by the performer, for providing tone data relating to musical tone signals to be generated in response to actions of the performer, said tone data comprising first data representing generation start and second data representing tone pitch; and vibrator means for vibrating the input means separate from any generation of sounds in response to the tone data thereby to impart vibrations to the input means.

2. An electronic musical instrument according to claim 1, wherein said vibrator means includes a vibrating plate which is driven by at least one driver and is disposed to be contacted by the input means when the input means is contacted by the performer.

3. An electronic musical instrument according to claim 2, wherein the input means is divided into a plurality of zones and a vibrating plate and at least one associated driver is provided for each of said zones.

4. An electronic musical instrument according to claim 1, wherein the input means includes at least two switches which are actuated in succession upon contact of the input means by the performer.

5. An electronic musical instrument according to claim 1, wherein the electronic musical instrument comprises a guitar type controller.

6. An electronic musical instrument comprising:

input means, adapted for contact by the performer, for providing tone data relating to musical tone signals to be generated in response to actions of the performer, said tone data comprising first data representing generation start and second data representing tone pitch; and vibrator means for vibrating the input means in response to the tone data thereby to impart vibrations to the input means, wherein the electronic musical instrument comprises a wind controller.

7. An electronic musical instrument, comprising:

a keyboard, adapted to be contacted by a performer, for providing tone data relating to musical tone signals to be generated in response to actions of the performer, said tone data comprising first data representing generation start and second data representing tone pitch; and vibrator means for vibrating the input means separate from any generation of sounds in response to the tone data thereby to impart vibrations to the keyboard.

8. An electronic musical instrument according to claim 7, wherein the vibrator means includes a vibrating plate which is driven by at least one driver and is disposed to be contacted by the keyboard when the keyboard is contacted by the performer.

9. An electronic musical instrument according to claim 8, wherein the keyboard is divided into a plurality of zones and a vibrating plate and at least one associated driver is provided for each of said zones.

10. An electronic musical instrument according to claim 7, wherein the keyboard includes a plurality of keys and at least a pair of switches associated with each key, the switches in a pair being actuated in succession upon contact of the associated key by the performer.

* * * * *